US012398598B2

(12) United States Patent
Nagasaka et al.

(10) Patent No.: US 12,398,598 B2
(45) Date of Patent: Aug. 26, 2025

(54) EARTH AUGER

(71) Applicant: MAKITA CORPORATION, Anjo (JP)

(72) Inventors: Hidenori Nagasaka, Anjo (JP); Tomohiko Imae, Anjo (JP); Yoshihiro Ito, Anjo (JP)

(73) Assignee: MAKITA CORPORATION, Anjo (JP)

( * ) Notice: Subject to any disclaimer, the term of this patent is extended or adjusted under 35 U.S.C. 154(b) by 84 days.

(21) Appl. No.: 18/206,692

(22) Filed: Jun. 7, 2023

(65) Prior Publication Data

US 2024/0044215 A1 Feb. 8, 2024

(30) Foreign Application Priority Data

Aug. 3, 2022 (JP) ..... 2022-124099

(51) Int. Cl.

*E21B 11/00* (2006.01)
*E21B 7/02* (2006.01)
*E21B 7/04* (2006.01)

(52) U.S. Cl.

CPC ..... *E21B 11/005* (2013.01); *E21B 7/027* (2013.01); *E21B 7/046* (2013.01)

(58) Field of Classification Search

CPC ..... E21B 11/005; B25F 5/026
See application file for complete search history.

(56) References Cited

U.S. PATENT DOCUMENTS

2020/0180124 A1* 6/2020 Ellice ..... B25F 5/026
2023/0082162 A1* 3/2023 Nagasaka ..... B23B 45/001 173/162.2

FOREIGN PATENT DOCUMENTS

DE 202020102840 U1 * 7/2020 ..... B25F 5/026
JP 2020-196098 A 12/2020

OTHER PUBLICATIONS

Translation for DE 202020102840 U1 (Year: 2025).*

* cited by examiner

*Primary Examiner* — Giovanna Wright
(74) *Attorney, Agent, or Firm* — Oliff PLC

(57) ABSTRACT

A hole is formed in a drill target with improved workability. An electric work machine includes a motor, a motor housing accommodating the motor, a handle housing including a grip including a trigger switch operable to activate the motor, a reducer, a gear housing accommodating the reducer, a rotation output unit protruding frontward from the gear housing and rotatable under a rotational force transmitted from the motor through the reducer with a drill bit being attached to the rotation output unit, and a handle fastened to the gear housing and at least partially located laterally from the gear housing.

10 Claims, 13 Drawing Sheets

EARTH AUGER

CROSS-REFERENCE TO RELATED APPLICATIONS

This application claims the benefit of priority to Japanese Patent Application No. 2022-124099, filed on Aug. 3, 2022, the entire contents of which are hereby incorporated by reference.

BACKGROUND

1. Technical Field

The present disclosure relates to an earth auger.

2. Description of the Background

In the technical field of earth augers, a known power tool drills the ground with a rotating earth auger drill bit, as described in Japanese Unexamined Patent Application Publication No. 2020-196098.

BRIEF SUMMARY

An earth auger is used to form a lateral hole. For a piping operation to install sewage pipes underground, for example, a technique is awaited to form lateral holes with improved workability.

The present disclosure is directed to forming a hole (in particular, a lateral hole) in a drill target with improved workability.

A first aspect of the present disclosure provides an earth auger, including:

- a motor;
- a motor housing accommodating the motor;
- a handle housing including a grip including a trigger switch operable to activate the motor;
- a reducer;
- a gear housing accommodating the reducer;
- a rotation output unit protruding frontward from the gear housing, the rotation output unit being rotatable under a rotational force transmitted from the motor through the reducer with a drill bit being attached to the rotation output unit; and
- a handle fastened to the gear housing and at least partially located laterally from the gear housing.

A second aspect of the present disclosure provides an earth auger, including:

- a motor;
- a motor housing accommodating the motor;
- a handle housing including a grip including a trigger switch operable to activate the motor;
- a reducer;
- a gear housing accommodating the reducer;
- a rotation output unit protruding frontward from the gear housing, the rotation output unit being rotatable under a rotational force transmitted from the motor through the reducer with a drill bit being attached to the rotation output unit; and
- a contact member located below the rotation output unit and at least partially located laterally from the gear housing.

The technique according to the above aspects of the present disclosure is used to form a hole (in particular, a lateral hole) in a drill target with improved workability.

DETAILED DESCRIPTION

Although one or more embodiments of the present disclosure will now be described with reference to the drawings, the present disclosure is not limited to the present embodiments. The components in the embodiments described below may be combined as appropriate. One or more components may be eliminated.

In the embodiments, the positional relationships between the components will be described using the directional terms such as right and left (or lateral), front and rear (or frontward and rearward), and up and down (or vertical). The terms indicate directions of an earth auger 1 during its use. For example, the earth auger 1 for sale at a store or in a sales catalog may be displayed upside down.

First Embodiment

Electric Work Machine

Figure 1:
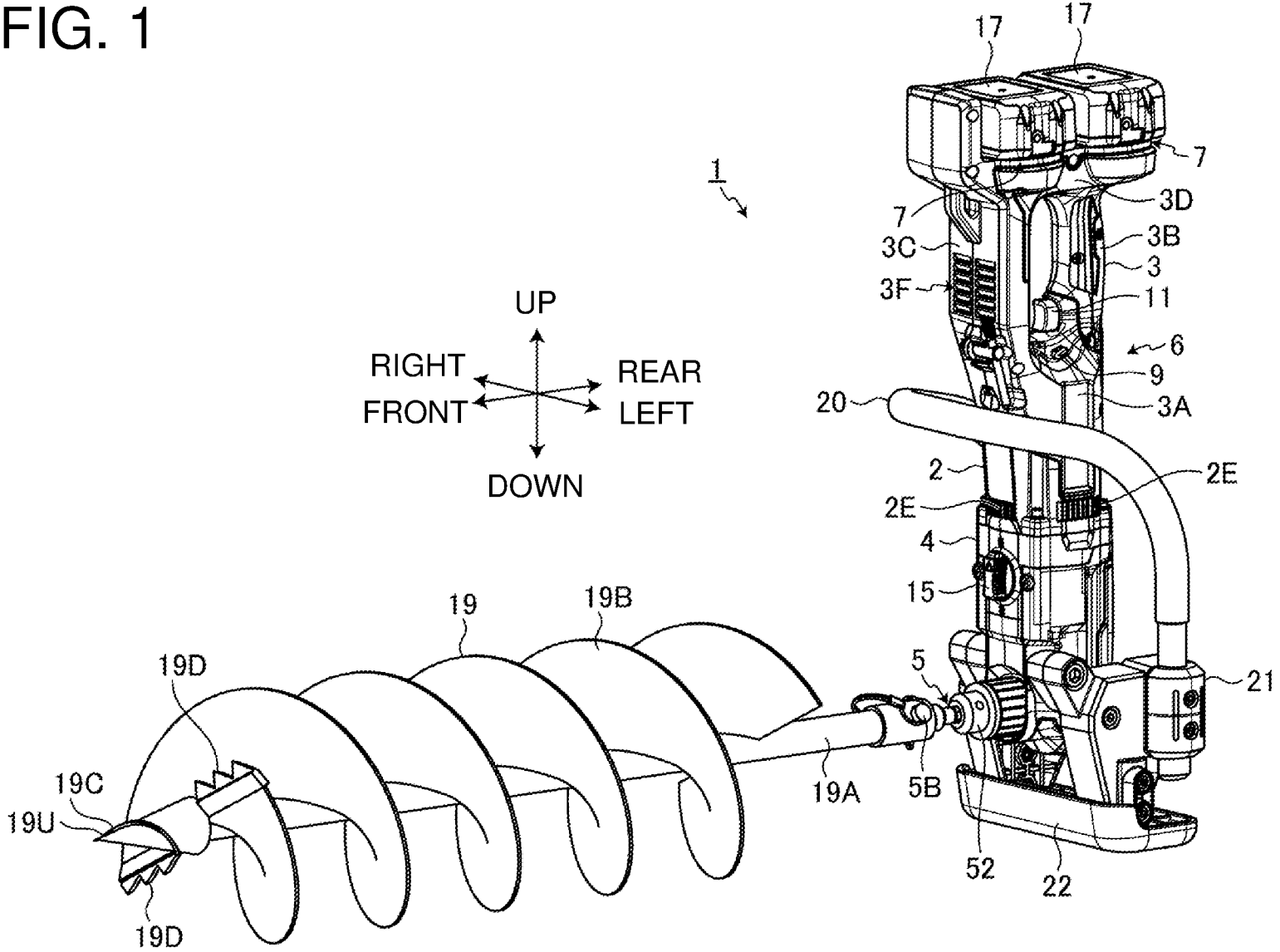
FIG. 1 is a front perspective view of an earth auger according to a first embodiment.
Figure 2:
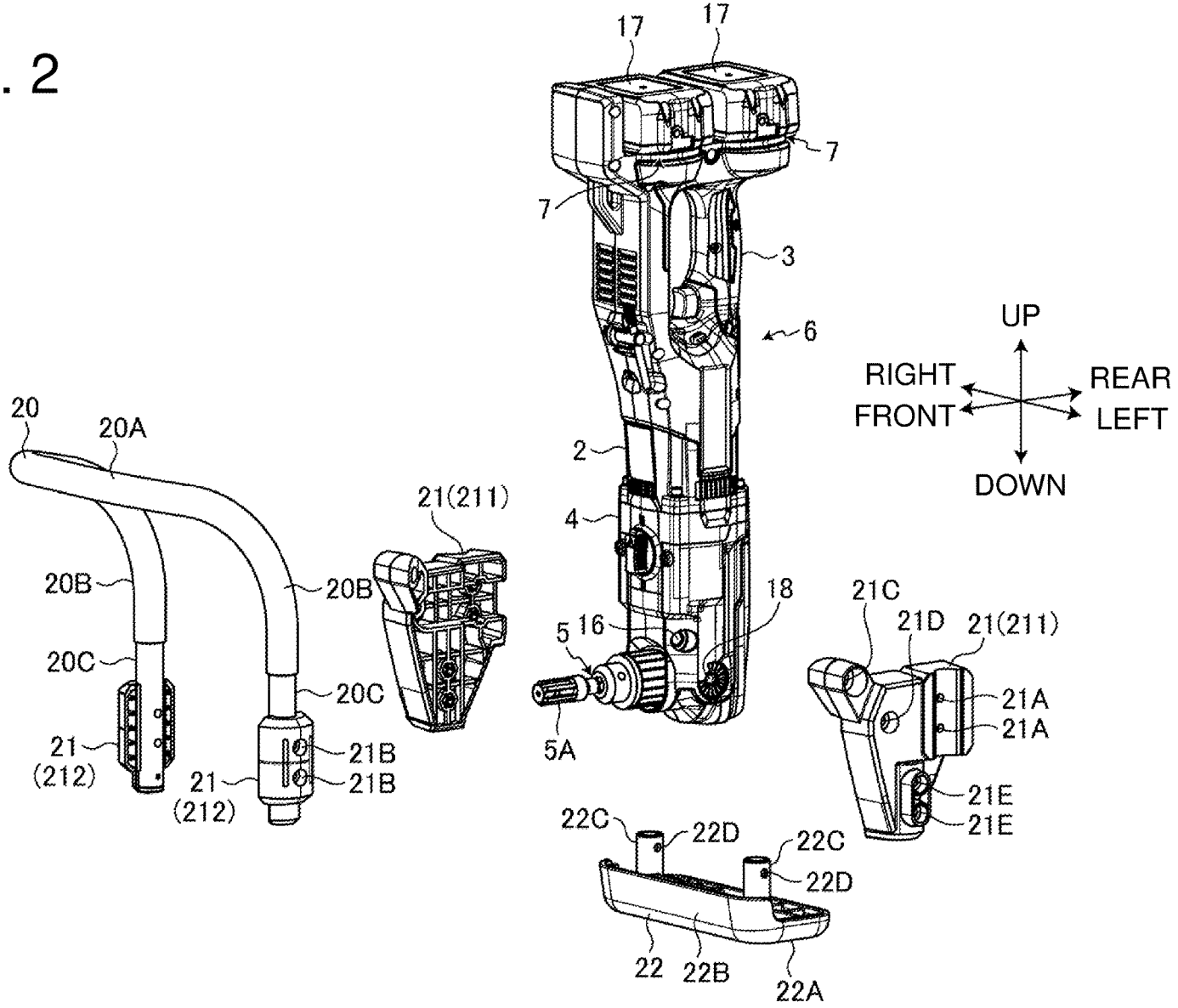
FIG. 2 is an exploded front perspective view of the earth auger according to the first embodiment.

FIG. 1 is a front perspective view of the earth auger 1 according to the present embodiment. FIG. 2 is an exploded front perspective view of the earth auger 1.

The earth auger 1 is a portable earth auger being held by an operator for drilling a drill target to form a hole in the drill target. The drill target is the ground in the present embodiment. The earth auger 1 is used to form a lateral hole in the ground. The earth auger 1 includes a body 6, a drill bit 19, an additional handle 20, and a contact member 22.

Figure 3:
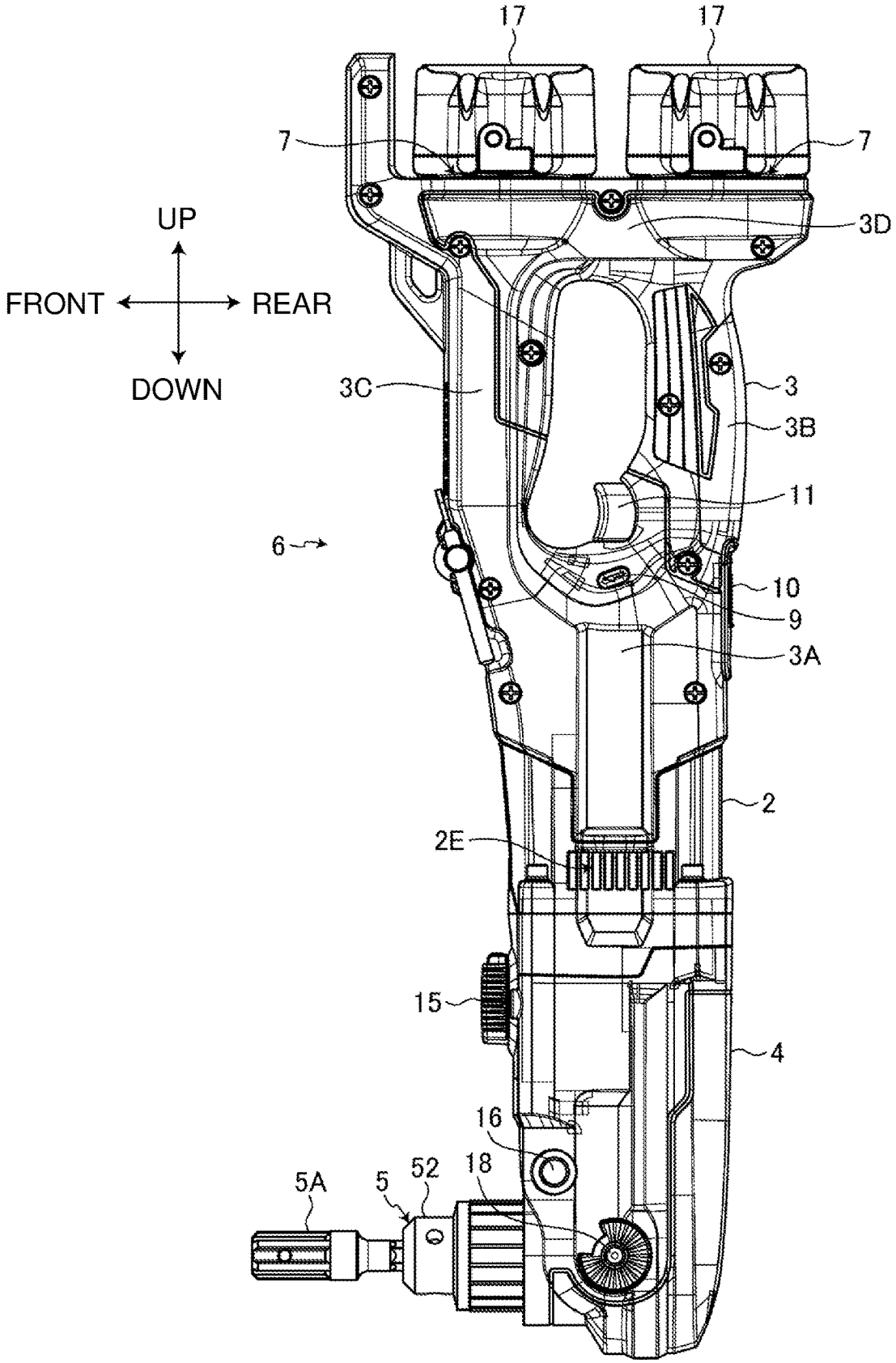
FIG. 3 is a side view of a body in the earth auger according to the first embodiment.
Figure 4:
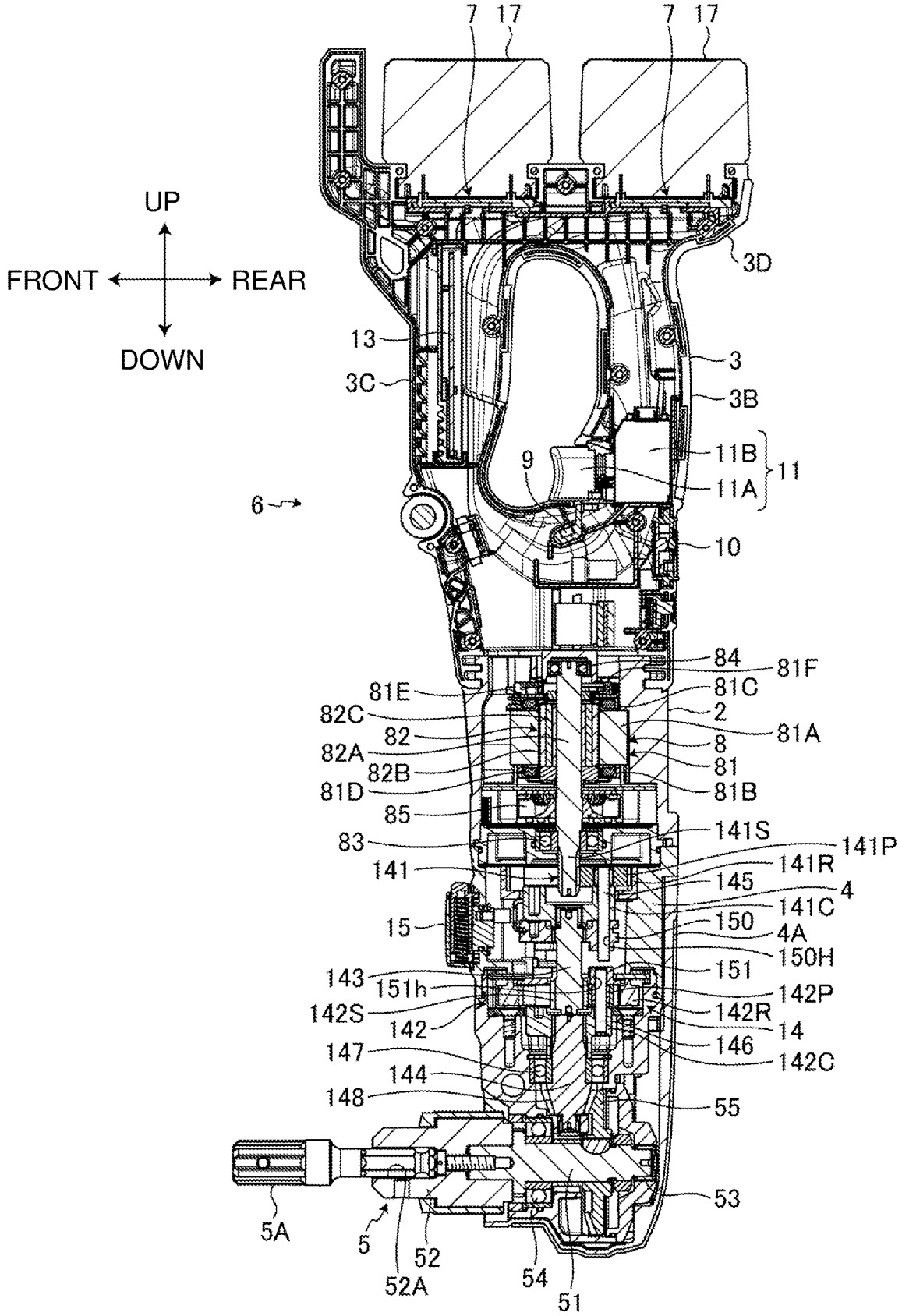
FIG. 4 is a sectional view of the body in the earth auger according to the first embodiment.

FIG. 3 is a side view of the body 6 of the earth auger 1. FIG. 4 is a sectional view of the body 6 in the earth auger 1.

As shown in FIGS. 1 to 4, the body 6 includes a motor housing 2, a handle housing 3, a gear housing 4, battery mounts 7, a controller 13, a main switch 10, a trigger switch 11, a forward-reverse switch lever 9, a speed switch lever 15, a motor 8, a reducer 14, and a rotation output unit 5.

The motor housing 2 accommodates the motor 8. The motor housing 2 is cylindrical and extends vertically. The motor housing 2 is formed from a synthetic resin. The motor housing 2 has outlets 2E. The outlets 2E connect the inside and the outside of the motor housing 2. The motor housing 2 has the outlets 2E in its left, right, and front. Air in an internal space of the motor housing 2 is discharged out of the motor housing 2 through the outlets 2E.

The handle housing 3 is located above the motor housing 2. The handle housing 3 includes a lower portion connected to an upper portion of the motor housing 2. The handle housing 3 is a vertically elongated loop. The handle housing 3 is formed from a synthetic resin. The handle housing 3 includes a front portion 3A, a grip 3B, a controller compartment 3C, and a battery connector 3D. The front portion 3A is connected to the upper portion of the motor housing 2. The grip 3B extends upward from the rear of the front portion 3A. The controller compartment 3C extends upward from the front of the front portion 3A. The battery connector 3D connects the upper end of the grip 3B and the upper end of the controller compartment 3C. The grip 3B is located rearward from the controller compartment 3C. The grip 3B is located above the motor housing 2. The operator may grip the grip 3B with a hand. The controller compartment 3C has an inlet 3F at the front.

The gear housing 4 accommodates the reducer 14. The gear housing 4 is cylindrical and extends vertically. The gear housing 4 is located below the motor housing 2. The gear housing 4 includes its upper portion connected to a lower portion of the motor housing 2. The gear housing 4 is formed from aluminum. The gear housing 4 has its surface at least partially covered with a cover 4A. The cover 4A in the embodiment has a two-layer structure of a synthetic resin and an elastomer.

The gear housing 4 has threaded holes 16 in its right and left portions. The threaded hole 16 are vertically aligned with the rotation output unit 5.

The gear housing 4 has threaded holes 18 in its right and left portions. The threaded holes 18 are located behind and below the corresponding threaded holes 16.

The battery mounts 7 are located in an upper portion of the handle housing 3. The battery mounts 7 receive battery packs 17. The battery mounts 7 are located on the battery connector 3D in the handle housing 3. The body 6 in the present embodiment includes two battery mounts 7 arranged in the front-rear direction. The two battery mounts 7 each receive the corresponding battery pack 17. The two battery packs 17 are thus arranged in the front-rear direction. The battery packs 17 are detachable from the battery mounts 7. The battery packs 17 attached to the battery mounts 7 power the earth auger 1. Each battery pack 17 includes a secondary battery. The battery pack 17 in the present embodiment includes a rechargeable lithium-ion battery.

The controller 13 outputs a control signal for controlling the earth auger 1. The controller compartment 3C has an internal space that can accommodate the controller 13. The controller 13 is accommodated in the controller compartment 3C.

The main switch 10 is operable by the operator to activate the earth auger 1. The main switch 10 is located on the rear of the front portion 3A. The main switch 10 causes the battery packs 17 to supply power to the controller 13. This activates the earth auger 1. The main switch 10 is operable to switch the earth auger 1 between the activated state and the stopped state.

The trigger switch 11 is operable by the operator to activate the motor 8. The trigger switch 11 is located in the grip 3B. The trigger switch 11 includes a trigger lever 11A and a switch circuit 11B. The trigger lever 11A protrudes frontward from a lower front portion of the grip 3B. The operator holding the grip 3B with the right or left hand operates the trigger lever 11A with a finger to move the trigger lever 11A backward. The grip 3B has an internal space that can accommodate the switch circuit 11B. The switch circuit 11B is accommodated in the grip 3B. In response to an operation on the trigger lever 11A, the switch circuit 11B outputs an operation signal. When the trigger lever 11A is pulled backward with the earth auger 1 being activated, the battery packs 17 supply power to the motor 8 and activate the motor 8. The motor 8 is driven in response to the operation signal output from the switch circuit 11B. The trigger lever 11A is operable to switch between the operation state and the release state to switch the motor 8 between the driving state and the stopped state.

The forward-reverse switch lever 9 is operable by the operator to switch the rotation direction of the motor 8. The forward-reverse switch lever 9 is located in the front portion 3A. The forward-reverse switch lever 9 is operable rightward or leftward to switch the rotation direction of the motor 8 between forward and reverse. This can switch the rotation direction of the rotation output unit 5 between forward and reverse.

The speed switch lever 15 is operable by the operator to switch the rotational speed of the rotation output unit 5. The speed switch lever 15 is located at the front of the gear housing 4. An operation on the speed switch lever 15 in the vertical direction switches the rotational speed of the rotation output unit 5 between a first speed and a second speed. The second speed is higher than the first speed.

The motor 8 generates a rotational force for rotating the rotation output unit 5. The motor 8 is driven by power supplied from the battery packs 17. The motor 8 is an inner-rotor brushless motor. The motor 8 includes a cylindrical stator 81 and a rotor 82 located inward from the stator 81. The rotor 82 has a rotation axis extending vertically.

The stator 81 includes a stator core 81A, a first insulator 81B, a second insulator 81C, multiple coils 81D, a sensor circuit board 81E, and a connection wire 81F. The stator core 81A includes multiple steel plates stacked on one another. The first insulator 81B is located in a lower portion of the stator core 81A. The second insulator 81C is located in an upper portion of the stator core 81A. The coils 81D are wound around the stator core 81A with the first insulator 81B and the second insulator 81C in between. The sensor circuit board 81E is attached to the second insulator 81C. The connection wire 81F is supported by the second insulator 81C. The sensor circuit board 81E includes multiple rotation detectors to detect rotation of the rotor 82.

The rotor 82 includes a rotor shaft 82A, a rotor core 82B, and multiple permanent magnets 82C. The rotor core 82B is cylindrical and surrounds the rotor shaft 82A. The permanent magnets 82C are held by the rotor core 82B. The rotor shaft 82A includes a lower portion rotatably supported by a bearing 83. The rotor shaft 82A includes an upper portion rotatably supported by a bearing 84.

A centrifugal fan 85 is mounted on a part of the rotor shaft 82A between the bearing 83 and the stator 81. The outlets 2E in the motor housing 2 are located to partially surround the centrifugal fan 85. As the rotor shaft 82A rotates and thus the centrifugal fan 85 rotates, air in the internal space of the motor housing 2 is discharged out of the motor housing 2 through the outlets 2E.

The rotor shaft 82A receives a pinion gear 141S on its lower end. The pinion gear 141S is located in an internal space of the gear housing 4. The rotor shaft 82A is connected to the reducer 14 with the pinion gear 141S in between.

The reducer 14 transmits a rotational force generated by the motor 8 to the rotation output unit 5. The reducer 14 transmits the rotational force through the rotor shaft 82A to the rotation output unit 5. The reducer 14 includes multiple gears. The reducer 14 includes a first planetary gear assembly 141, a second planetary gear assembly 142, a countershaft 143, and an output shaft 144.

The first planetary gear assembly 141 is located below the rotor shaft 82A. The countershaft 143 is located below the first planetary gear assembly 141. The second planetary gear assembly 142 is located below the countershaft 143. The output shaft 144 is located below the second planetary gear assembly 142.

The first planetary gear assembly 141 includes the pinion gear 141S, multiple planetary gears 141P, a first carrier 141C, an internal gear 141R, and a support pin 145. The pinion gear 141S serves as a sun gear. The planetary gears 141P surround the pinion gear 141S. The first carrier 141C supports the planetary gears 141P in a rotatable manner. The internal gear 141R surrounds the planetary gears 141P. The support pin 145 is held by the first carrier 141C.

The pinion gear 141S is located at the lower end of the rotor shaft 82A. The planetary gears 141P mesh with the pinion gear 141S and the internal gear 141R. The first carrier 141C holds the support pin 145. The support pin 145 extends vertically. The support pin 145 is connected to the planetary gears 141P. The first carrier 141C supports the planetary gears 141P in a rotatable manner with the support pin 145.

The second planetary gear assembly 142 includes a sun gear 142S, multiple planetary gears 142P, a second carrier 142C, an internal gear 142R, and a support pin 146. The planetary gears 142P surround the sun gear 142S. The second carrier 142C supports the planetary gears 142P in a rotatable manner. The internal gear 142R surrounds the planetary gears 142P. The support pin 146 is held by the second carrier 142C.

The sun gear 142S is located at the lower end of the countershaft 143. The planetary gears 142P mesh with the sun gear 142S and the internal gear 142R. The second carrier 142C holds the support pin 146. The support pin 146 extends vertically. The support pin 146 protrudes upward from the second carrier 142C. The support pin 146 supports the planetary gears 142P in a rotatable manner. The support pin 146 has its upper end protruding upward from the planetary gears 142P. The second carrier 142C supports the planetary gears 142P in a rotatable manner with the support pin 146.

The internal gear 141R in the first planetary gear assembly 141 is fixed to the gear housing 4. The internal gear 141R does not rotate. The internal gear 142R in the second planetary gear assembly 142 is rotatable.

The output shaft 144 is rotatably supported by the bearing 147. The output shaft 144 has its upper end fixed to the second carrier 142C. The output shaft 144 receives a bevel gear 148 at its lower end. The output shaft 144 has the lower end connected to the rotation output unit 5 with the bevel gear 148 in between. As the second carrier 142C rotates, the second carrier 142C and the output shaft 144 rotate together.

The rotation axis of the rotor shaft 82A, the rotation axis of the first carrier 141C, the rotation axis of the countershaft 143, the rotation axis of the second carrier 142C, and the rotation axis of the output shaft 144 are aligned with one another.

The reducer 14 includes a switching member 150. The switching member 150 is movable vertically between the first planetary gear assembly 141 and the second planetary gear assembly 142. The switching member 150 surrounds the countershaft 143. The switching member 150 is connected to the speed switch lever 15. In response to an operation on the speed switch lever 15, the switching member 150 moves vertically.

The switching member 150 is located below the first carrier 141C. The support pin 145 includes a lower portion protruding downward from the first carrier 141C. The switching member 150 has a hole 150H. The support pin 145 protruding downward from the first carrier 141C is placed in the hole 150H. The switching member 150 is movable vertically while being guided by the support pin 145. This switches the rotational speed of the rotation output unit 5.

The reducer 14 includes a connector 151. The connector 151 is located in an upper portion of the planetary gear 142P. The connector 151 has a hole 151H. The support pin 146 protruding upward from the planetary gears 142P is placed in the hole 151H. The connector 151 is connected to the second carrier 142C with the support pin 146.

The switching member 150 is movable between a first position and a second position. The second position is below the first position. The switching member 150 is movable between the first position and the second position while being guided by the support pin 145.

At the first position, the switching member 150 is connected to the first carrier 141C and the countershaft 143. At the first position, the switching member 150 is apart from the connector 151. At the first position, the switching member 150 is integral with the first carrier 141C and the upper end the countershaft 143. At the first position, the switching member 150 rotates together with the first carrier 141C and the countershaft 143 as the first carrier 141C rotates.

At the second position, the switching member 150 is connected to the connector 151. At the second position, the switching member 150 is apart from the first carrier 141C and the countershaft 143. With the switching member 150 at the second position, the upper end of the countershaft 143 and the first carrier 141C are apart. At the second position, the switching member 150 is integral with the connector 151. The support pin 145 is placed in the hole 150H in the switching member 150. The support pin 145 is connected to the planetary gears 141P. At the second position, the switching member 150 rotates together with the connector 151 as the planetary gear 141P revolves.

At the first position, the switching member 150 is connected to the countershaft 143 with splines. At the second position, the switching member 150 is disconnected from the countershaft 143 in response to disengagement of the splines.

With the switching member 150 at the first position, the pinion gear 141S rotates and the planetary gears 141P revolve about the pinion gear 141S as the motor 8 drives the rotor shaft 82A to rotate. At the first position, the switching member 150 is integral with the first carrier 141C and the upper end of the countershaft 143. As the planetary gears 141P revolve, the first carrier 141C, the countershaft 143, and the switching member 150 rotate together at a lower rotational speed than the rotor shaft 82A. As the countershaft 143 rotates, the sun gear 142S rotates. The planetary gears 142P then revolve about the sun gear 142S. The second carrier 142C and the output shaft 144 then rotate at a lower rotational speed than the countershaft 143. With the switching member 150 at the first position, both the first planetary gear assembly 141 and the second planetary gear assembly 142 operate for rotation reduction as the motor 8 drives, thus causing the output shaft 144 to rotate at the first speed.

With the switching member 150 at the second position, the pinion gear 141S rotates and the planetary gears 141P revolve about the pinion gear 141S as the motor 8 drives the rotor shaft 82A to rotate. The first carrier 141C then rotates at a lower rotational speed than the rotor shaft 82A. At the second position, the switching member 150 is apart from the first carrier 141C and the countershaft 143. With the switching member 150 at the second position, the upper end of the countershaft 143 and the first carrier 141C are apart. At the second position, the switching member 150 is integral with the connector 151. With the switching member 150 at the second position, the support pin 145 is placed in the hole 150H in the switching member 150. The revolving planetary gears 141P cause the connector 151 and the switching member 150 to rotate at the same rotational speed as the first carrier 141C. The rotating connector 151 causes the planetary gears 142P to revolve at a revolution speed that is the same as the rotational speed of the connector 151. The revolving planetary gears 142P cause the second carrier 142C and the output shaft 144 to rotate at the same rotational speed. With the switching member 150 at the second position, the first planetary gear assembly 141 operates for rotation reduction as the motor 8 drives, but the second planetary gear assembly 142 does not operate for rotation reduction. The output shaft 144 thus rotates at the second speed.

The rotation output unit 5 rotates under a rotational force transmitted from the motor 8 through the reducer 14. The rotation output unit 5 protrudes frontward from the lower portion of the gear housing 4. The rotation output unit 5 receives a drill bit. The rotation output unit 5 with the drill bit being attached is rotatable. The rotation output unit 5 has a rotation axis extending in the front-rear direction. The motor 8 has the rotation axis orthogonal to the rotation axis of the rotation output unit 5.

The rotation output unit 5 includes a spindle 51 and a drill chuck 52. The drill chuck 52 is attached to the front end of the spindle 51. The drill chuck 52 has an insertion hole 52A. The drill bit is placed in the insertion hole 52A. The insertion hole 52A extends rearward from the front end of the drill chuck 52. The drill chuck 52 with the drill bit 19 being attached is rotatable.

The spindle 51 is rotatably supported by a needle bearing 53 and a ball bearing 54. The needle bearing 53 supports the rear end of the spindle 51 in a rotatable manner. The ball bearing 54 supports the front of the spindle 51 in a rotatable manner.

The spindle 51 receives a bevel gear 55 at its rear. The bevel gear 55 meshes with the bevel gear 148 on the output shaft 144. The bevel gear 55 has a larger diameter than the bevel gear 148. The bevel gear 55 includes more teeth than the bevel gear 148.

The rotation output unit 5 receives the drill bit 19. The drill bit 19 is an earth auger drill bit used for drilling. The drill bit 19 includes a drill shaft 19A, a double-helix drill blade 19B, a tip bit 19C, and two cutting blades 19D.

The drill shaft 19A extends in the front-rear direction. To attach the drill bit 19 to the rotation output unit 5, an adapter 5A is placed in the insertion hole 52A in the drill chuck 52. The adapter 5A is a rod-like member. The drill shaft 19A includes a hole to receive the adapter 5A at its rear end. With the adapter 5A placed in the hole at the rear end of the drill shaft 19A, the rear end of the drill shaft 19A and the adapter 5A are fastened with a fastener 5B. The rear end of the drill shaft 19A is attached to the drill chuck 52 using the adapter 5A.

The double-helix drill blade 19B spirally surrounds the drill shaft 19A. The double-helix drill blade 19B is fixed to the drill shaft 19A. The tip bit 19C is at the front end of the drill shaft 19A. Each of the two cutting blades 19D is located at the front end of the double-helix drill blade 19B.

The additional handle 20 is fastened to the gear housing 4 with handle joints 21. The handle joints 21 are located on the left and right of the gear housing 4. Each handle joint 21 includes a base 211 and a fixing portion 212. The base 211 includes a screw opening 21C and a screw opening 21D. The fixing portion 212 has screw openings 21B. A screw placed in the screw opening 21C is screwed into the threaded hole 16. A screw placed in the screw opening 21D is screwed into the threaded hole 18. The base 211 in the handle joint 21 is thus fastened to the gear housing 4.

The additional handle 20 is at least partially located laterally from the gear housing 4. Being laterally from the gear housing 4 refers to being either leftward or rightward or both from the gear housing 4. In the present embodiment, the additional handle 20 is partially located leftward from the gear housing 4. The additional handle 20 is partially located rightward from the gear housing 4.

The additional handle 20 is formed from a hollow metal pipe that is bent. The additional handle 20 includes insertion portions 20C, vertical rods 20B, and a lateral rod 20A. Each insertion portion 20C is fixed between the base 211 and the fixing portion 212 of the handle joint 21. Each vertical rod 20B extends upward from the insertion portion 20C. The lateral rod 20A extends laterally. The additional handle 20 includes a pair of insertion portions 20C. The insertion portions 20C in the pair are at an interval from each other in the lateral direction. The additional handle 20 includes a pair of vertical rods 20B. The vertical rods in the pair are at an interval from each other in the lateral direction. Each vertical rod 20B includes an upper portion sloping upward toward the front. The lateral rod 20A connects the upper ends of the vertical rods 20B in the pair.

The insertion portion 20C has multiple screw openings. The screw openings in the insertion portion 20C are at an interval from each other in the vertical direction. The screw openings 21B are located in the fixing portion 212 of the handle joint 21. Threaded holes 21A are located in the base 211 in the handle joint 21. With the insertion portion 20C between the base 211 and the fixing portion 212, a screw placed in the screw opening 21B is screwed into the threaded hole 21A through the screw opening in the insertion portion 20C. The additional handle 20 is thus fastened to the handle joints 21.

The additional handle 20 is fastened to the handle joints 21, and the handle joints 21 are fastened to the gear housing 4. The additional handle 20 is thus fastened to the gear housing 4 with the handle joints 21 in between. In this state, the vertical rods 20B extend upward from lateral portions of the gear housing 4. One vertical rod 20B extends upward from the left portion of the gear housing 4. The other vertical rod 20B extends upward from the right portion of the gear housing 4. The lateral rod 20A is located frontward from the gear housing 4.

The contact member 22 is located below the rotation output unit 5. The contact member 22 is at least partially located laterally from the gear housing 4. The contact member 22 has its left portion located leftward from the gear housing 4. The contact member 22 has its right portion located rightward from the gear housing 4. In other words, the contact member 22 has its left end located leftward from the left surface of the gear housing 4. The contact member 22 has its right end located rightward from the right surface of the gear housing 4.

The contact member 22 is fastened to the gear housing 4 with the handle joints 21 in between. Each base 211 in the corresponding handle joint 21 has an insertion hole (not shown) extending upward from the lower surface of the base 211. The contact member 22 includes a pair of insertion portions 22C. The insertion portions 22C are placed in the insertion holes in the base 211. The insertion portions 22C in the pair are arranged at an interval from each other in the lateral direction. Each insertion portion 22C has multiple threaded holes 22D. The threaded holes 22D are at an interval from each other in the vertical direction. Each handle joint 21 has screw openings 21E. With the insertion portions 22C placed in second insertion holes, a screw placed in the corresponding screw opening 21E is screwed into the corresponding threaded hole 22D. The contact member 22 is thus fastened to the handle joints 21.

The contact member 22 is fastened to the handle joints 21, and the handle joints 21 are fastened to the gear housing 4. The contact member 22 is thus fastened to the gear housing 4 with the handle joints 21 in between. In this state, a contact surface 22A of the contact member 22 faces downward, and a front surface 22B of the contact member 22 faces frontward.

Method of Use

Figure 5:
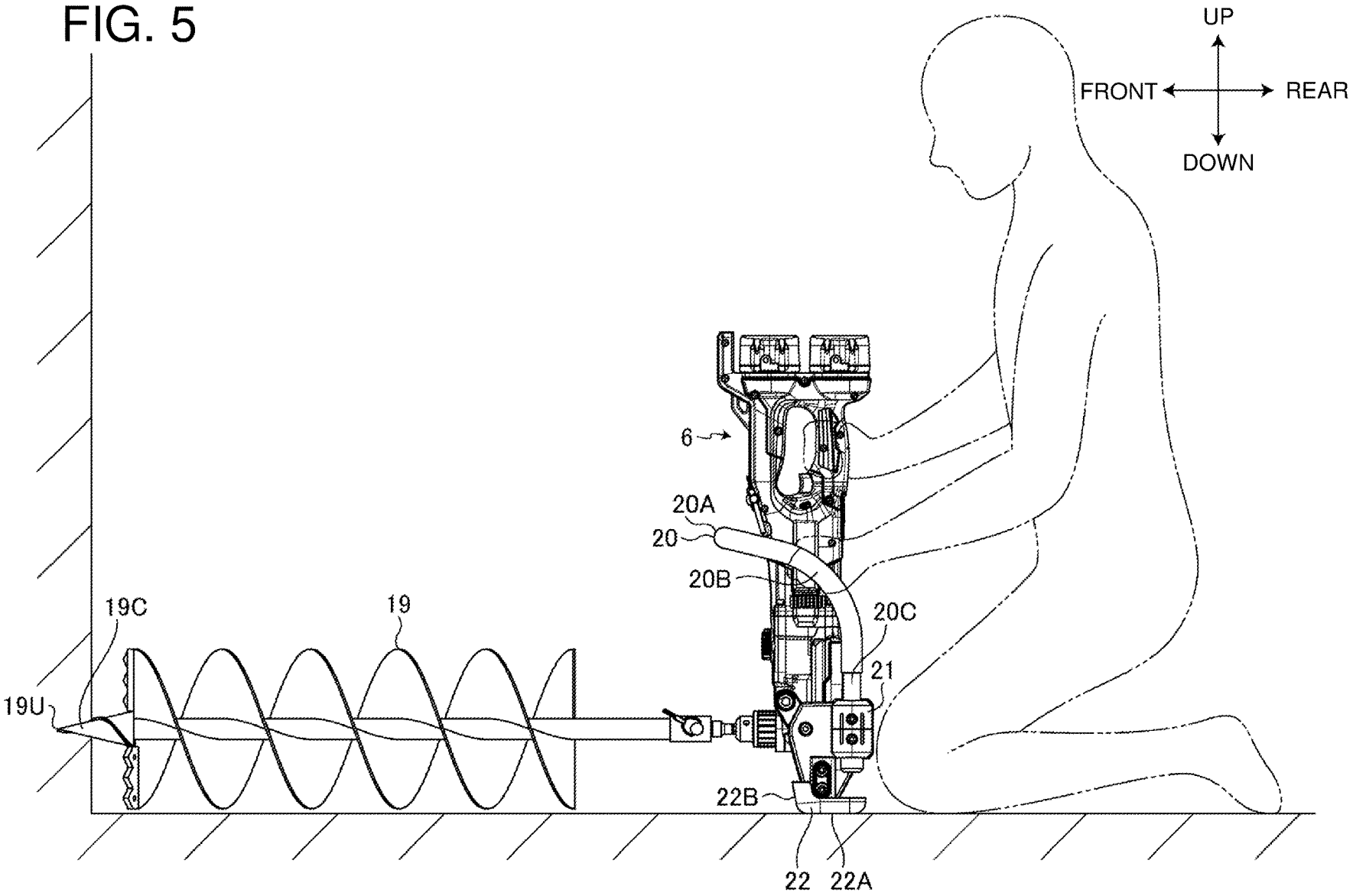
FIG. 5 is a side view of the earth auger according to the first embodiment, describing its use.
Figure 6:
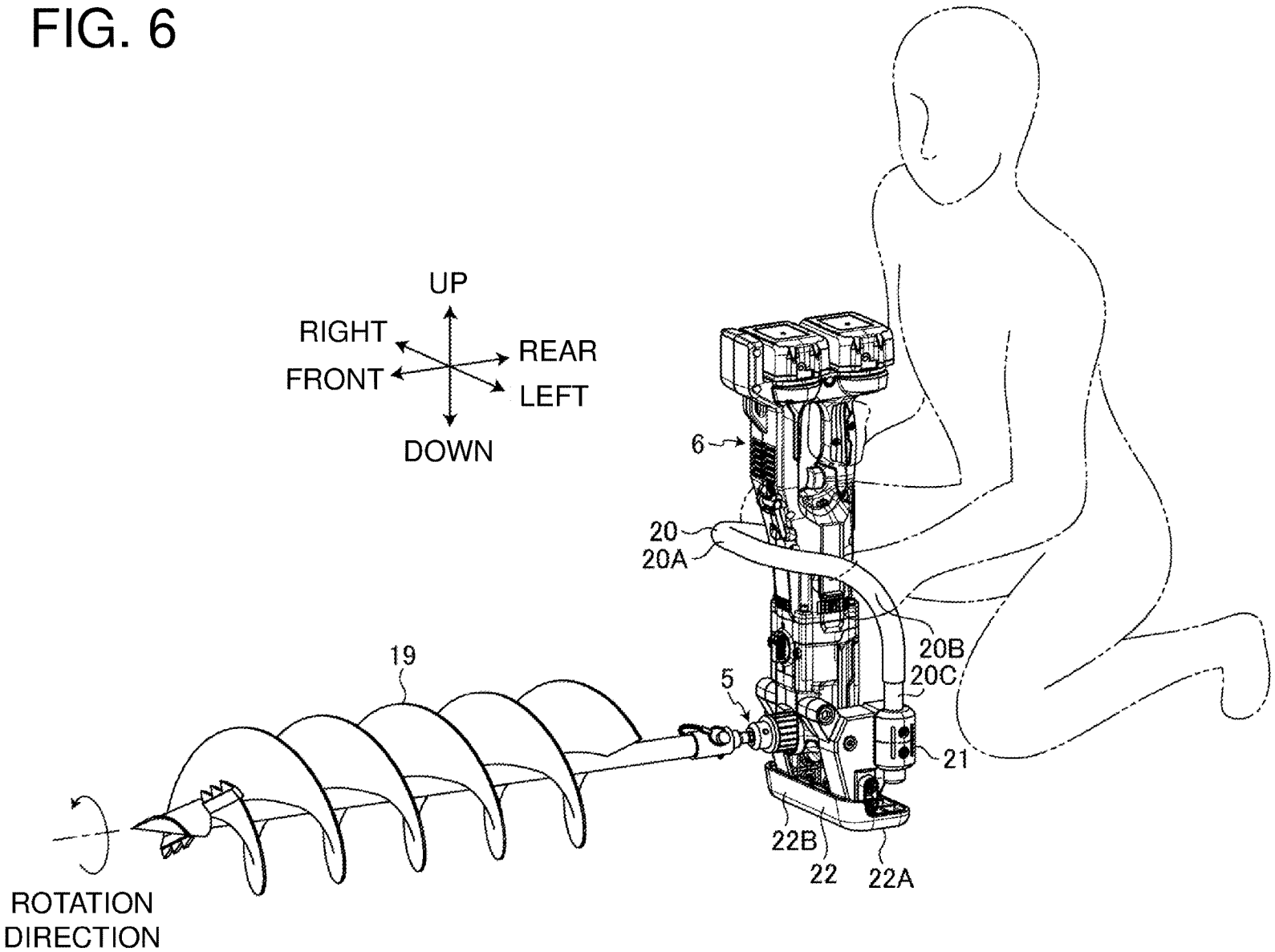
FIG. 6 is a perspective view of the earth auger according to the first embodiment, describing its use.

A method of use of the earth auger 1 according to the present embodiment will now be described. FIG. 5 is a side view of the earth auger 1 according to the present embodiment, describing its use. FIG. 6 is a perspective view of the earth auger 1, describing its use. The earth auger 1 is used to form a lateral hole in a drill target. The earth auger 1 is used with the motor housing 2 located above the gear housing 4. In other words, the earth auger 1 is used in a vertical position. With the motor housing 2 located above the gear housing 4 in the vertical position, the contact member 22 is fixed to the gear housing 4. The contact member 22 is in contact with the ground.

The operator grips the additional handle 20 with the left hand and the grip 3B in the handle housing 3 with the right hand. The operator grips the left of the lateral rod 20A or the left vertical rod 20B with the left hand. The operator operates the trigger lever 11A with, for example, a little finger of the right hand holding the grip 3B. This causes the rotation output unit 5 to rotate in a rotation direction indicated by the arrow in FIG. 6, with the drill bit 19 being attached.

With the contact surface 22A in contact with the ground, the operator presses a front end 19U of the rotating drill bit 19 against the drill target in front of the earth auger 1. This allows drilling into the drill target to form a lateral hole in the drill target. The operator pushes the earth auger 1 forward with the drill bit 19 rotating. The contact member 22 may slide on the ground. This allows the earth auger 1 to move forward smoothly. To discharge a drilled material from the lateral hole formed in the drill target, the operator pulls out the earth auger 1 backward. The earth auger 1 moves backward smoothly as well.

The operator may grip the additional handle 20 with the right hand and the grip 3B in the handle housing 3 with the left hand. The operator may grip the right of the lateral rod 20A or the right vertical rod 20B with the right hand.

During a drilling operation into the drill target, a large reaction force may act on the gear housing 4 through the drill bit 19 and the rotation output unit 5. When the drill bit 19 rotates in the rotation direction indicated by the arrow in FIG. 6, a reaction force may act to cause the upper end of the body 6 to fall leftward.

In the present embodiment, the left portion of the contact member 22 is located leftward from the gear housing 4. The left portion of the contact member 22 is in contact with the ground, receiving a reaction force acting on the gear housing 4.

The additional handle 20 gripped by the operator receives a reaction force acting on the gear housing 4.

The grip 3B is gripped by the operator. The handle housing 3 thus receives a reaction force acting on the gear housing 4.

As described above, the earth auger 1 includes the motor 8, the motor housing 2 accommodating the motor 8, the handle housing 3 including the grip 3B including the trigger switch 11 operable to activate the motor 8, the reducer 14, the gear housing 4 accommodating the reducer 14, the rotation output unit 5 protruding frontward from the gear housing 4 and rotatable under a rotational force transmitted from the motor 8 through the reducer 14 with the drill bit 19 being attached to the rotation output unit 5, and the additional handle 20 fastened to the gear housing 4 and at least partially located laterally from the gear housing 4.

With the above structure, the operator can perform a drilling operation while gripping the additional handle 20 with one hand and the grip 3B in the handle housing 3 with the other hand. This allows formation of a lateral hole in the drill target with improved workability.

Second Embodiment

A second embodiment will now be described. The same or corresponding components as those in the above embodiment are given the same reference numerals herein and will be described briefly or will not be described.

Figure 7:
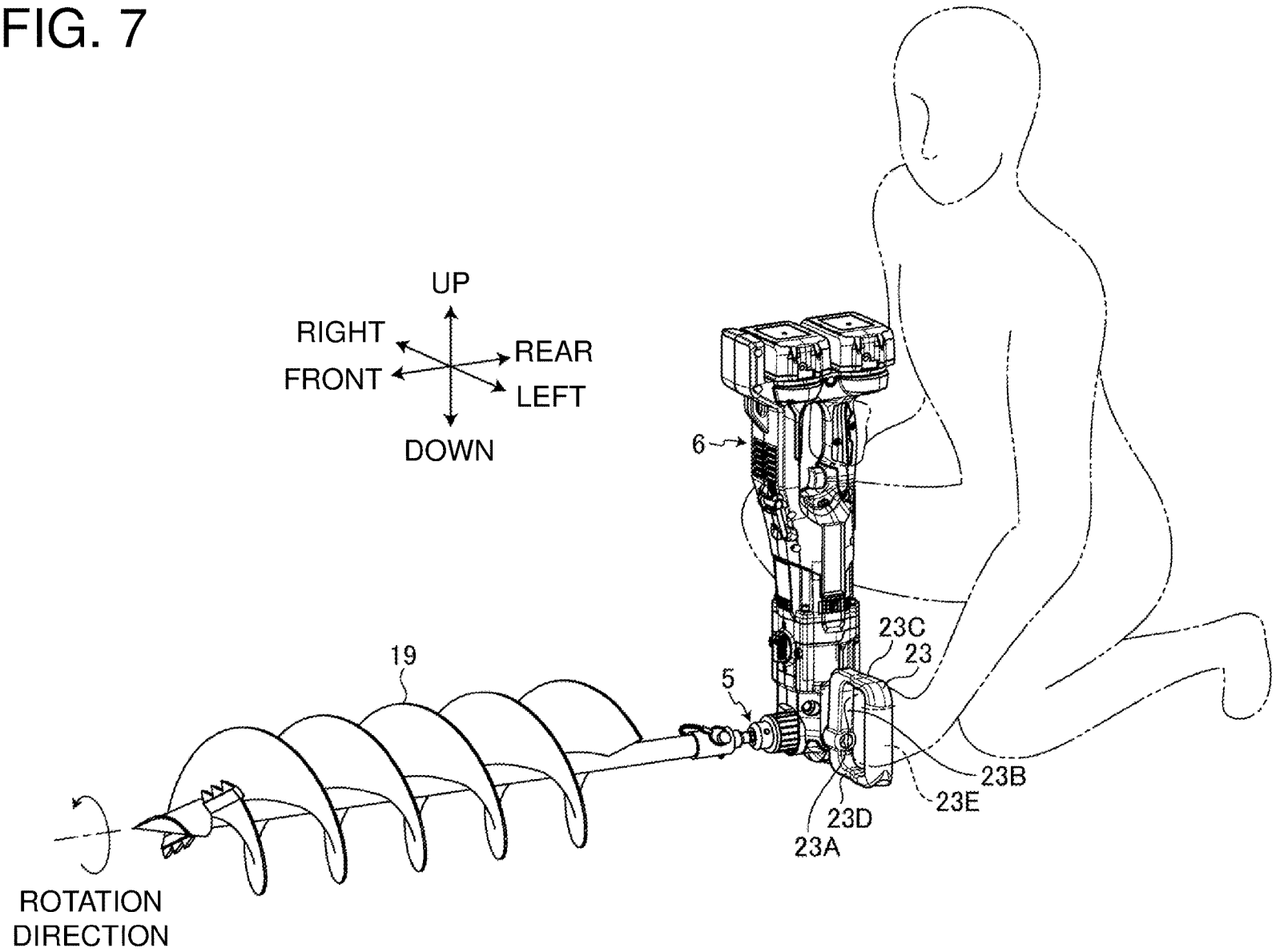
FIG. 7 is a perspective view of an earth auger according to a second embodiment, describing its use.

FIG. 7 is a perspective view of an earth auger 1 according to the present embodiment, describing its use. In the present embodiment, the contact member 22 and the handle joints 21 are eliminated.

A loop-shaped additional handle 23 is fastened to the left portion of the gear housing 4. The operator can grip any part of the additional handle 23. The additional handle 23 includes a facing portion 23B, a grip portion 23E, an upper joint 23C, and a lower joint 23D. The facing portion 23B faces the left surface of the gear housing 4. The grip portion 23E is located leftward from the facing portion 23B. The upper joint 23C connects an upper portion of the facing portion 23B to an upper portion of the grip portion 23E. The lower joint 23D connects a lower portion of the facing portion 23B to a lower portion of the grip portion 23E. The facing portion 23B has a screw opening 23A. A screw placed in the screw opening 23A is screwed into the threaded hole 18. The additional handle 23 is thus fastened to the gear housing 4.

As in the first embodiment described above, the earth auger 1 is used in a vertical position with the motor housing 2 located above the gear housing 4. In this state, the lower end of the gear housing 4 is flush with at least a part of the additional handle 23. In the embodiment, the lower end of the gear housing 4 is flush with the lower end of the lower joint 23D. With the lower end of the gear housing 4 in contact with the ground, the additional handle 23 is at least partially in contact with the ground. In the embodiment, the lower end of the lower joint 23D is in contact with the ground.

The operator grips the grip portion 23E in the additional handle 23 with the left hand and the grip 3B in the handle housing 3 with the right hand. The operator operates the trigger lever 11A with a finger of the right hand holding the grip 3B. This causes the rotation output unit 5 to rotate in a rotation direction indicated by the arrow in FIG. 7, with the drill bit 19 being attached.

With the lower joint 23D in the additional handle 23 in contact with the ground, the operator presses the front end 19U of the rotating drill bit 19 against the drill target in front of the earth auger 1. This allows drilling into the drill target to form a lateral hole in the drill target. The operator pushes the earth auger 1 forward with the drill bit 19 rotating. The lower joint 23D may slide on the ground. This allows the earth auger 1 to move forward smoothly. To discharge a drilled material from the lateral hole formed in the drill target, the operator pulls out the earth auger 1 backward. The earth auger 1 moves backward smoothly as well.

During a drilling operation into the drill target, a large reaction force may act on the gear housing 4 through the drill bit 19 and the rotation output unit 5. When the drill bit 19 rotates in the rotation direction indicated by the arrow in FIG. 7, a reaction force may act to cause the upper end of the body 6 to fall leftward.

The additional handle 23 is at least partially located laterally from the gear housing 4 to receive a reaction force transmitted from the rotation output unit 5 to the gear housing 4. In the present embodiment, the additional handle 23 is located leftward from the gear housing 4. The grip portion 23E in the additional handle 23 is gripped by the operator, and the lower joint 23D in the additional handle 23 is in contact with the ground. The additional handle 23 thus receives a reaction force acting on the gear housing 4.

Third Embodiment

Figure 8:
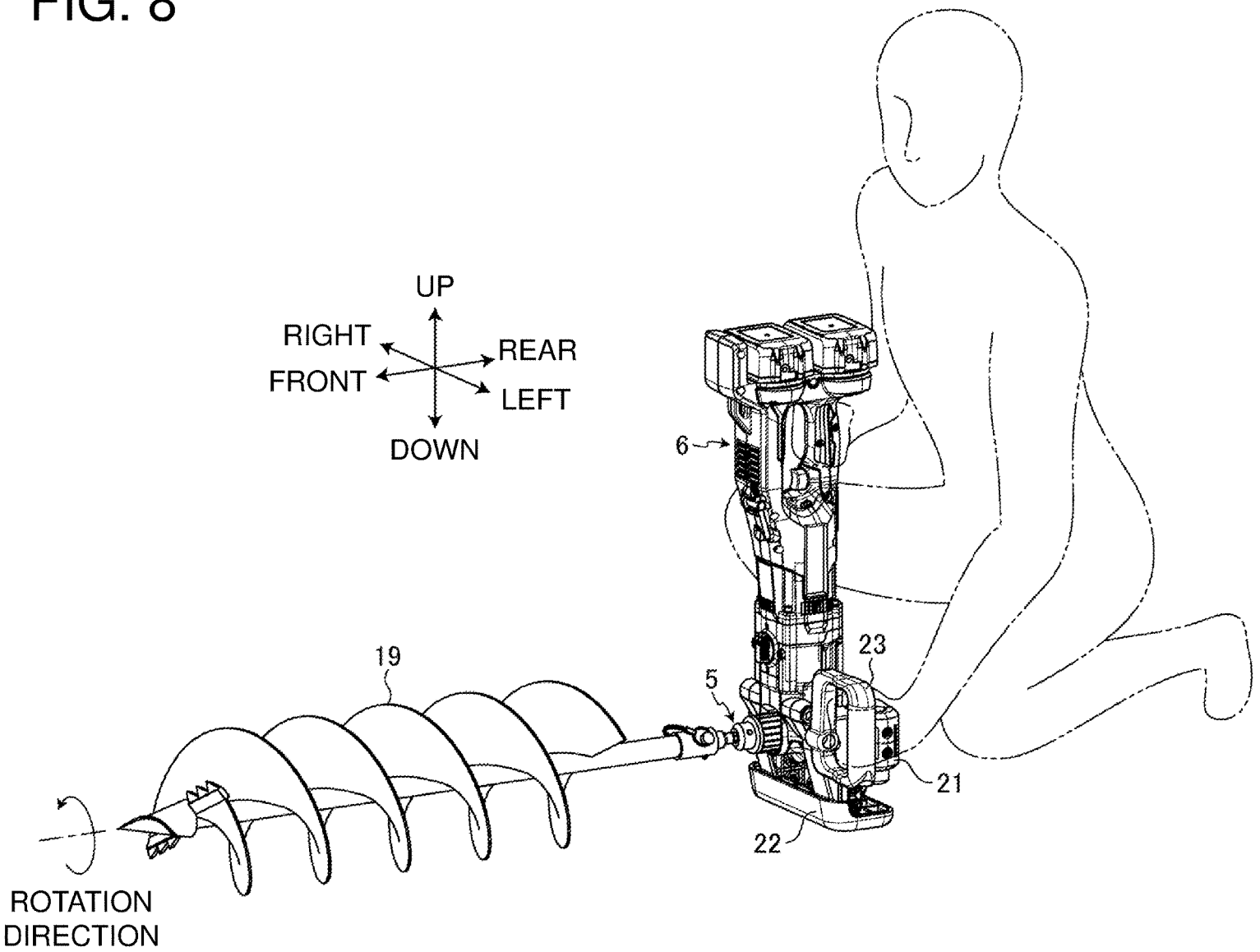
FIG. 8 is a perspective view of an earth auger according to a third embodiment, describing its use.

A third embodiment will now be described. The same or corresponding components as those in the above embodiments are given the same reference numerals herein and will be described briefly or will not be described. 15 FIG. 8 is a perspective view of an earth auger 1 according to the present embodiment, describing its use. In the present embodiment, the contact member 22 and the additional handle 23, which are described in the above embodiments, are fastened to the gear housing 4.

In the present embodiment, the left portion of the contact member 22 is located below the additional handle 23. In the present embodiment, the contact member 22 protrudes 20 leftward more largely from the left surface of the gear housing 4 than the contact member 22 in the first embodiment described above. The additional handle 23 is not in contact with the ground.

In the present embodiment, the contact member 22 protrudes leftward largely from the left surface of the gear housing 4. The contact member 22 thus receives a reaction force 25 acting on the gear housing 4 with the left portion of the contact member 22 in contact with the ground. The operator grips the grip portion 23E in the additional handle 23 located leftward from gear housing 4. The additional handle 23 thus receives a reaction force acting on the gear housing 4.

Fourth Embodiment

A fourth embodiment will now be described. The same or corresponding components as those in the above embodiment are given the same reference numerals herein and will be described briefly or will not be described.

Figure 9:
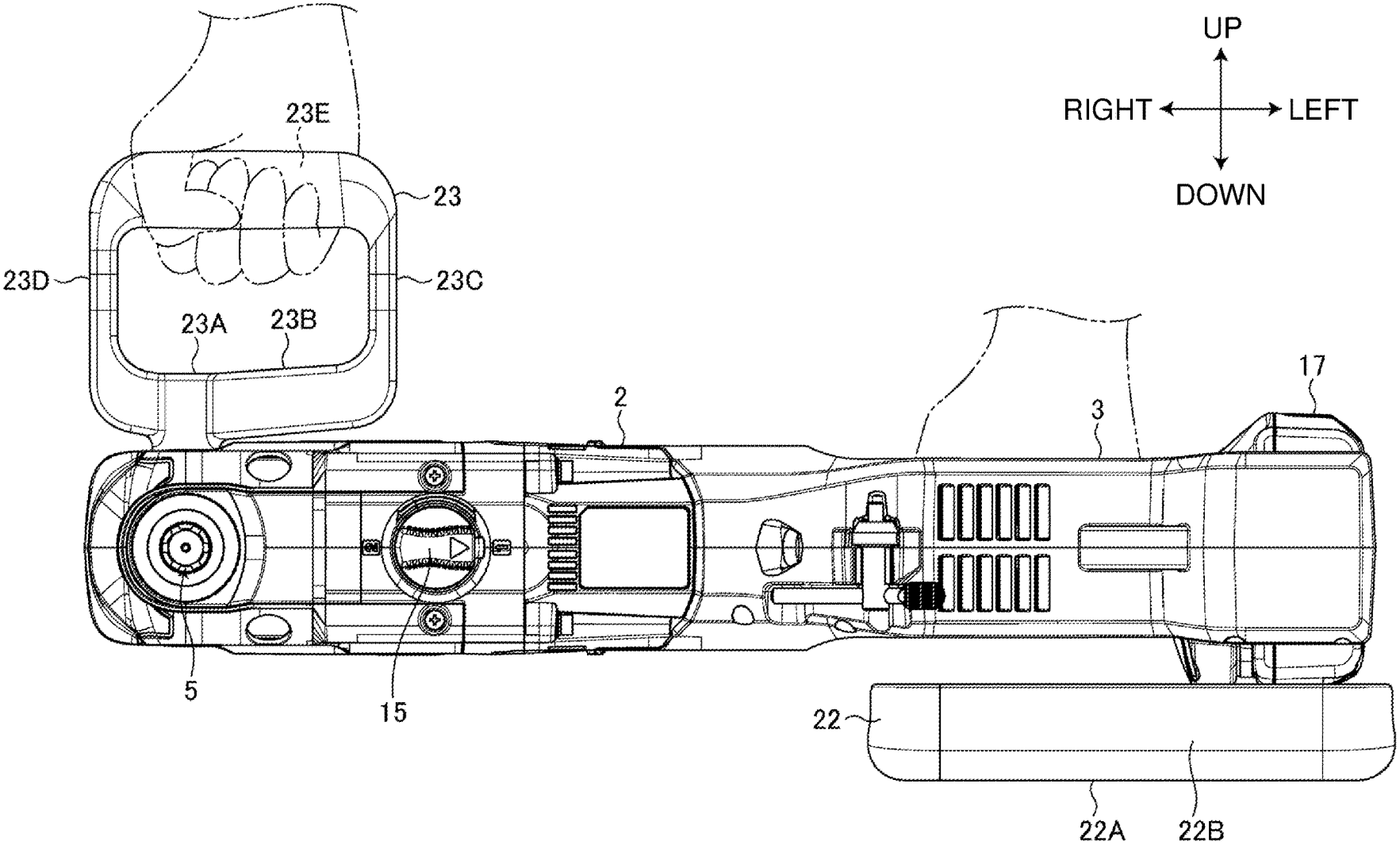
FIG. 9 is a front view of an earth auger according to a fourth embodiment, describing its use.
Figure 10:
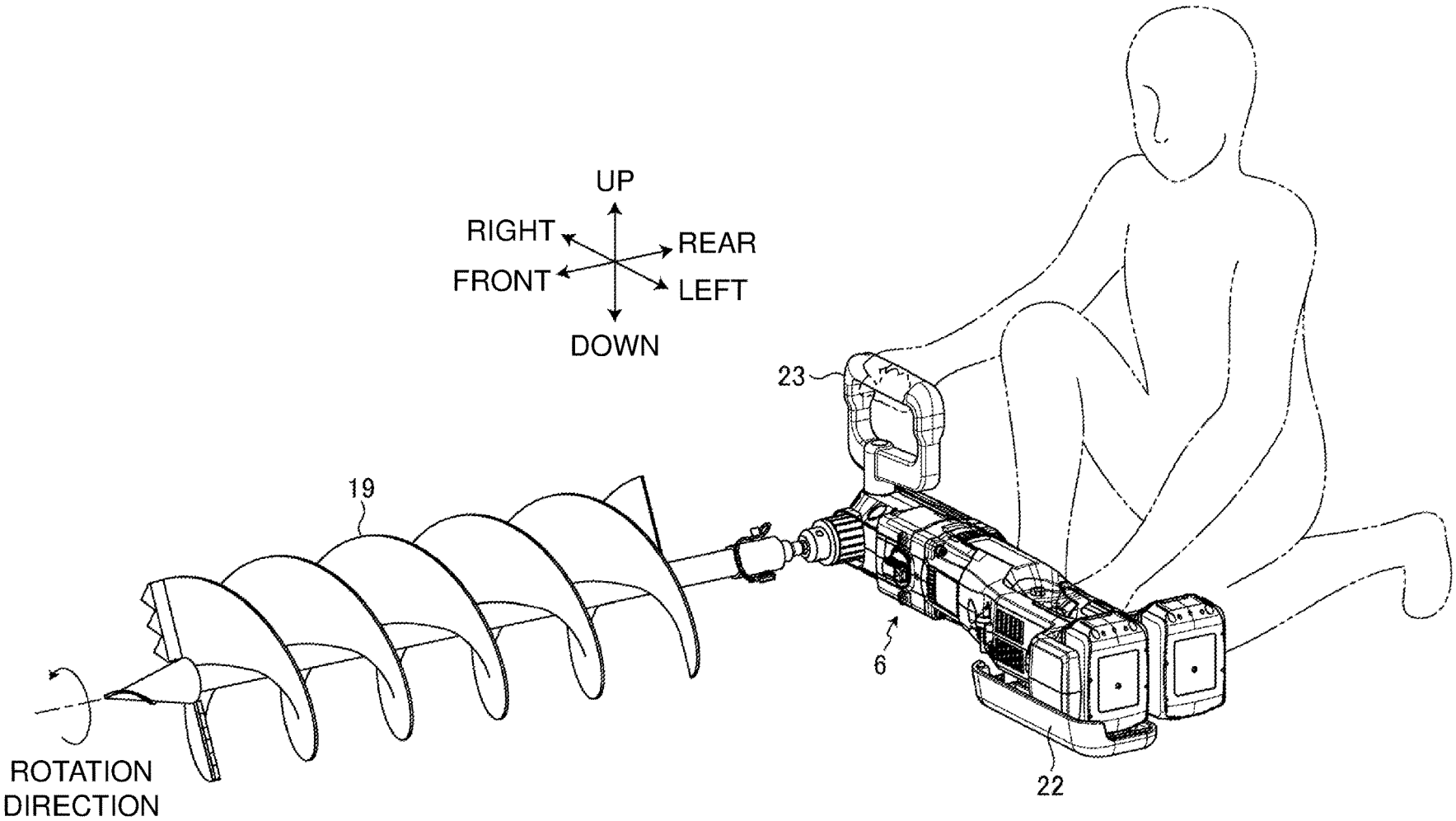
FIG. 10 is a perspective view of the earth auger according to the fourth embodiment, describing its use.

FIG. 9 is a front view of an earth auger 1 according to the present embodiment, describing its use. FIG. 10 is a perspective view of the earth auger 1 according to the present embodiment, describing its use. The earth auger 1 according to the present embodiment is used in a lateral position with the motor housing 2 located laterally (rightward) from the gear housing 4. The body 6 receives the contact member 22 and the additional handle 23, which are described in the above embodiments.

The additional handle 23 is located above the gear housing 4 in the lateral position with the motor housing 2 located laterally from the gear housing 4. The additional handle 23 is fastened to the gear housing 4. The contact member 22 is fastened to the handle housing 3.

The operator grips the grip portion 23E in the additional handle 23 with the right hand and the grip 3B in the handle housing 3 with the left hand. The operator operates the trigger lever 11A with a finger of the left hand holding the grip 3B. This causes the rotation output unit 5 to rotate in a rotation direction indicated by the arrow in FIG. 10, with the drill bit 19 being attached.

With the contact member 22 in contact with the ground, the operator presses the front end 19U of the rotating drill bit 19 against the drill target in front of the earth auger 1. This allows drilling into the drill target to form a lateral hole in the drill target. The operator pushes the earth auger 1 forward with the drill bit 19 rotating. The contact member 22 slides on the ground. This allows the earth auger 1 to move forward smoothly. To discharge a drilled material from the lateral hole formed in the drill target, the operator pulls out the earth auger 1 backward. The earth auger 1 moves backward smoothly as well.

In the present embodiment, the additional handle 23 is located above the gear housing 4. The operator grips the grip portion 23E in the additional handle 23. The additional handle 23 thus receives a reaction force acting on the gear housing 4. The contact member 22 located leftward from the gear housing 4 is in contact with the ground. The contact member 22 thus receives a reaction force acting on the gear housing 4.

Fifth Embodiment

A fifth embodiment will now be described. The same or corresponding components as those in the above embodiment are given the same reference numerals herein and will be described briefly or will not be described.

Figure 11:
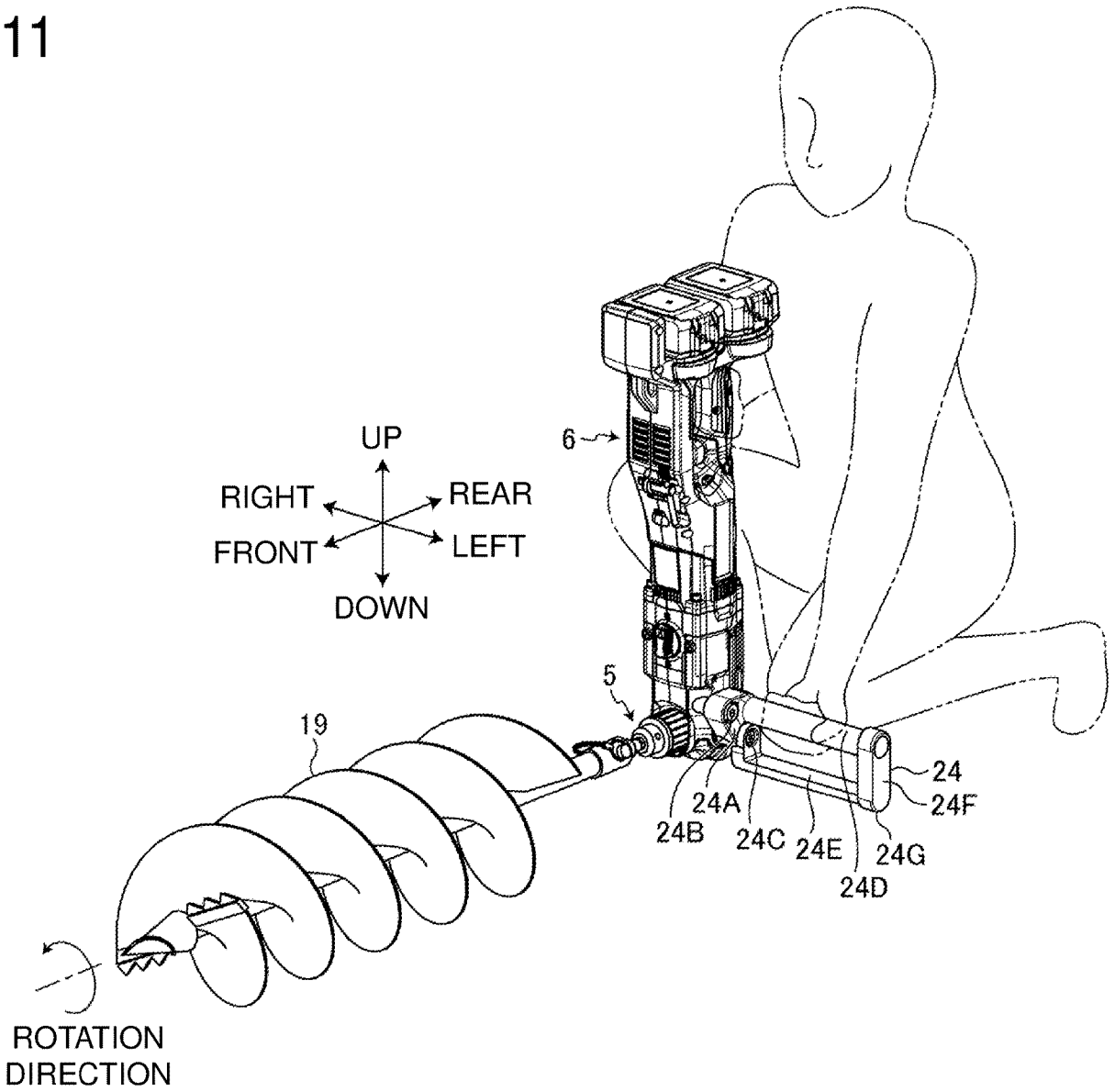
FIG. 11 is a perspective view of an earth auger according to a fifth embodiment, describing its use.
Figure 12:
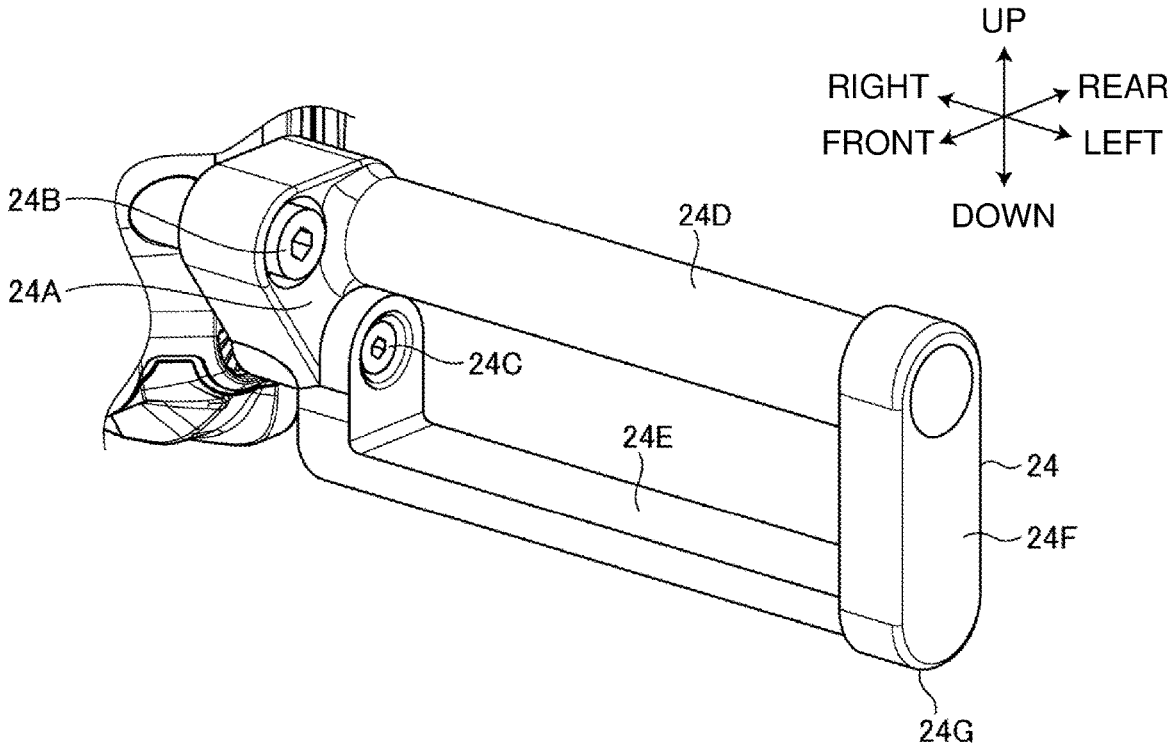
FIG. 12 is a perspective view of an additional handle in the fifth embodiment.

FIG. 11 is a perspective view of an earth auger 1 according to the present embodiment, describing its use. FIG. 12 is a perspective view of an additional handle 24 in the present embodiment. In the present embodiment, the additional handle 24 is loop-shaped and is fastened to the left portion of the gear housing 4. The additional handle 24 includes a facing portion 24A, a joint 24F, a straight portion 24D, and a hand guard 24E. The facing portion 24A faces the left surface of the gear housing 4. The joint 24F is located leftward from the facing portion 24A. The straight portion 24D connects an upper portion of the facing portion 24A to an upper portion of the joint 24F. The hand guard 24E connects a lower portion of the facing portion 24A to a lower portion of the joint 24F. The straight portion 24D extends laterally (leftward) from the gear housing 4. The hand guard 24E is located below the straight portion 24D. The joint 24F has a lower end 24G located below the hand guard 24E.

The facing portion 24A has a screw opening 24B and a screw opening 24C. A screw placed in the screw opening 24B is screwed into the threaded hole 16. A screw placed in the screw opening 24C is screwed into the threaded hole 18. The additional handle 24 is thus fastened to the gear housing 4.

The earth auger 1 according to the present embodiment is used in a vertical position with the motor housing 2 located above the gear housing 4. In this state, the lower end of the gear housing 4 is flush with at least a part of the additional handle 24. In the embodiment, the lower end of the gear housing 4 is flush with the lower end 24G of the joint 24F. With the lower end of the gear housing 4 in contact with the ground, the additional handle 24 is at least partially in contact with the ground. In the embodiment, the lower end 24G of the joint 24F is in contact with the ground.

The operator grips the straight portion 24D in the additional handle 24 with the left hand and the grip 3B in the handle housing 3 with the right hand. The operator operates the trigger lever 11A with a finger of the right hand holding the grip 3B. This causes the rotation output unit 5 to rotate in a rotation direction indicated by the arrow in FIG. 11, with the drill bit 19 being attached.

With the lower end 24G of the joint 24F in contact with the ground, the operator presses the front end 19U of the rotating drill bit 19 against the drill target in front of the earth auger 1. This allows drilling into the drill target to form a lateral hole in the drill target. The operator pushes the earth auger 1 forward with the drill bit 19 rotating. The lower end 24G of the joint 24F slides on the ground. This allows the earth auger 1 to move forward smoothly. To discharge a drilled material from the lateral hole formed in the drill target, the operator pulls out the earth auger 1 backward. The earth auger 1 moves backward smoothly as well.

In the present embodiment, the additional handle 24 is located leftward from the gear housing 4. The straight portion 24D in the additional handle 24 is gripped by the operator, and the lower end 24G of the joint 24F is in contact with the ground. The additional handle 24 thus receives a reaction force acting on the gear housing 4. The hand guard 24E prevents the operator's left hand from coming in contact with the ground. When the additional handle 24 receives a reaction force acting on the gear housing 4, the hand guard 24E prevents the operator's hand (left hand) from being caught between the ground and the straight portion 24D.

The lower end 24G in the present embodiment protrudes downward from the left end of the hand guard 24E. The lower end 24G of the additional handle 24 is located farthest from the rotation output unit 5. The lower end 24G in contact with the ground fully receives a reaction force acting on the gear housing 4. The lower end 24G has a small contact area with the ground. The earth auger 1 thus moves smoothly in the front-rear direction.

Sixth Embodiment

A sixth embodiment will now be described. The same or corresponding components as those in the above embodiment are given the same reference numerals herein and will be described briefly or will not be described.

Figure 13:
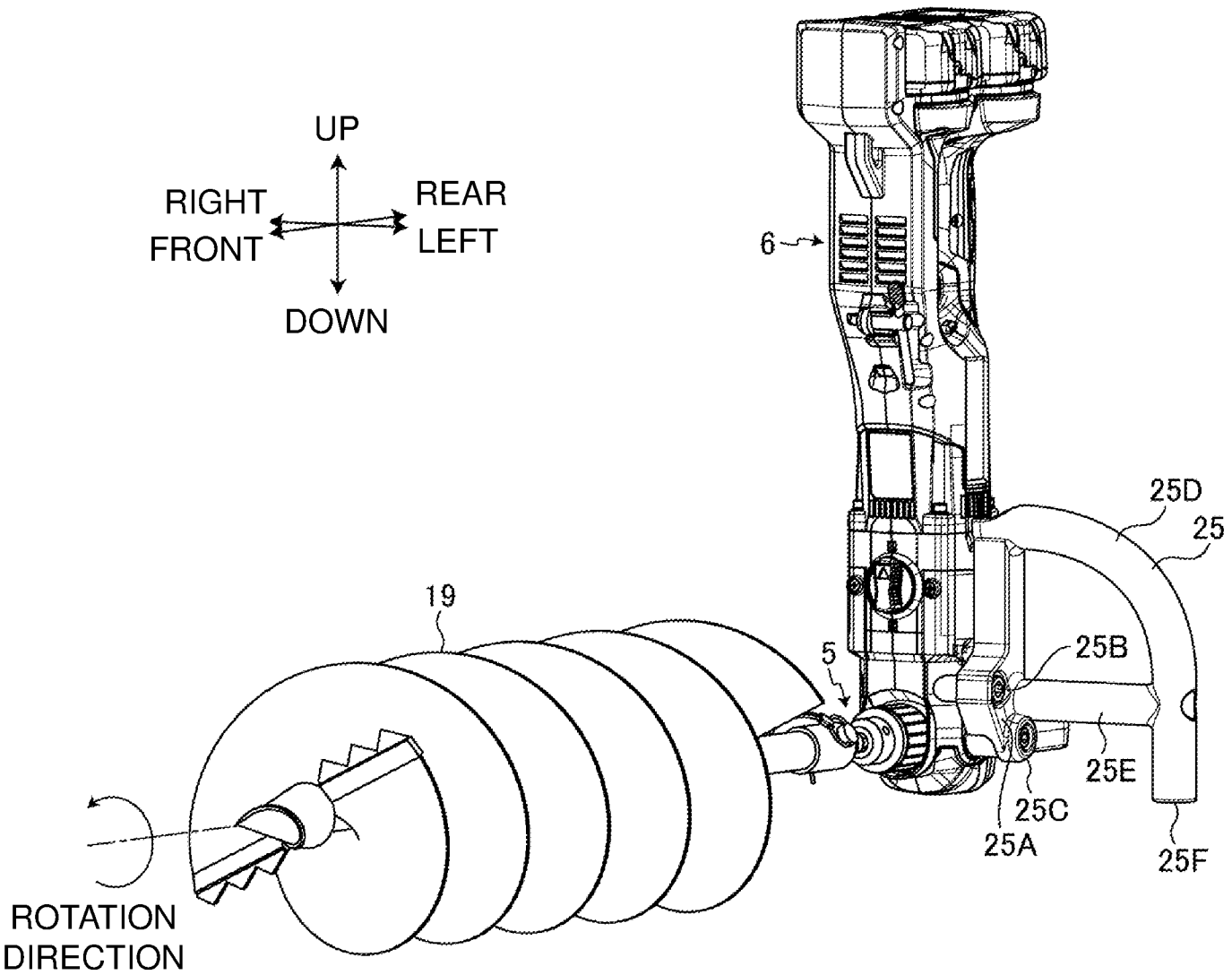
FIG. 13 is a front perspective view of an earth auger according to a sixth embodiment.

FIG. 13 is a front perspective view of an earth auger 1 according to the present embodiment. In the present embodiment, a loop-shaped additional handle 25 is fastened to the left portion of the gear housing 4. The additional handle 25 includes a facing portion 25A, a bend 25D, and a straight portion 25E. The facing portion 25A faces the left surface of the gear housing 4. The bend 25D is connected to the upper end of the facing portion 25A. The straight portion 25E is connected to a lower portion of the facing portion 25A. The bend 25D is curved downward at a farther distance leftward from the gear housing 4. The straight portion 25E extends laterally (leftward) from the gear housing 4 below the bend 25D. The straight portion 25E has its left end connected to a part of the bend 25D. The bend 25D has a lower end 25F located below the straight portion 25E. The operator can grip at least either a part of the bend 25D or a part of the straight portion 25E.

The facing portion 25A has a screw opening 25B and a screw opening 25C. A screw placed in the screw opening 25B is screwed into the threaded hole 16. A screw placed in the screw opening 25C is screwed into the threaded hole 18. The additional handle 25 is thus fastened to the gear housing 4.

The earth auger 1 according to the present embodiment is used in a vertical position with the motor housing 2 located above the gear housing 4. In this state, the lower end of the gear housing 4 is flush with at least a part of the additional handle 25. In the embodiment, the lower end of the gear housing 4 is flush with the lower end 25F of the bend 25D. With the lower end of the gear housing 4 in contact with the ground, the additional handle 25 is at least partially in contact with the ground. In the embodiment, the lower end 25F of the bend 25D is in contact with the ground.

The operator grips the bend 25D in the additional handle 25 with the left hand and the grip 3B in the handle housing 3 with the right hand. The operator may grip the straight portion 25E in the additional handle 25 with the left hand. The operator operates the trigger lever 11A with a finger of the right hand holding the grip 3B. This causes the rotation output unit 5 to rotate in a rotation direction indicated by the arrow in FIG. 13, with the drill bit 19 being attached.

With the lower end 25F of the bend 25D in contact with the ground, the operator presses the front end 19U of the rotating drill bit 19 against the drill target in front of the earth auger 1. This allows drilling into the drill target to form a lateral hole in the drill target. The operator pushes the earth auger 1 forward with the drill bit 19 rotating. The lower end 25F of the bend 25D slides on the ground. This allows the earth auger 1 to move forward smoothly. To discharge a drilled material from the lateral hole formed in the drill target, the operator pulls out the earth auger 1 backward. The earth auger 1 moves backward smoothly as well.

In the present embodiment, the lower end 25F has a small contact area with the ground. The earth auger 1 thus moves smoothly in the front-rear direction.

In the present embodiment, the additional handle 25 is located leftward from the gear housing 4. The bend 25D in the additional handle 25 is gripped by the operator, and the lower end 25F of the bend 25D in the additional handle 25 is in contact with the ground. The additional handle 25 thus receives a reaction force acting on the gear housing 4.

REFERENCE SIGNS LIST

1 earth auger
2 motor housing
2E outlet
3 handle housing
3A front portion
3B grip
3C controller compartment
3D battery connector
3F inlet
4 gear housing

4A cover
5 rotation output unit
5A adapter
5B fastener
6 body
7 battery mount
8 motor
9 forward-reverse switch lever
10 main switch
11 trigger switch
11A trigger lever
11B switch circuit
13 controller
14 reducer
15 speed switch lever
16 threaded hole
17 battery pack
18 threaded hole
19 drill bit
19A drill shaft
19B double-helix drill blade
19C tip bit
19D cutting blade
19U front end
20 additional handle
20A lateral rod
20B vertical rod
20C insertion portion
21 handle joint
21A threaded hole
21B screw opening
21C screw opening
21D screw opening
21E screw opening
22 contact member
22A contact surface
22B front surface
22C insertion portion
22D threaded hole
23 additional handle
23A screw opening
23B facing portion
23C upper joint
23D lower joint
23E grip portion
24 additional handle
24A facing portion
24B screw opening
24C screw opening
24D straight portion
24E hand guard
24F joint
24G lower end
25 additional handle
25A facing portion
25B screw opening
25C screw opening
25D bend
25E straight portion
25F lower end
51 spindle
52 drill chuck
52A insertion hole
53 needle bearing
54 ball bearing
55 bevel gear
81 stator
81A stator core
81B first insulator
81C second insulator
81D coil
81E sensor circuit board
81F connection wire
82 rotor
82A rotor shaft
82B rotor core
82C permanent magnet
83 bearing
84 bearing
85 centrifugal fan
141 first planetary gear assembly
141C first carrier
141P planetary gear
141R internal gear
141S pinion gear
142 second planetary gear assembly
142C second carrier
142P planetary gear
142R internal gear
142S sun gear
143 countershaft
144 output shaft
145 support pin
146 support pin
147 bearing
148 bevel gear
150 switching member
150H hole
151 connector
151H hole
211 base
212 fixing portion

What is claimed is:

1. An earth auger, comprising:
a motor;
a motor housing accommodating the motor;
a handle housing including a grip including a trigger switch operable to activate the motor;
a reducer;
a gear housing accommodating the reducer;
a rotation output unit protruding frontward from the gear housing, the rotation output unit being rotatable under a rotational force transmitted from the motor through the reducer with a drill bit being attached to the rotation output unit; and
a handle fastened to the gear housing and at least partially located laterally from the gear housing,
wherein
with the motor housing located above the gear housing, the gear housing has a lower end flush with at least a part of the handle, and
with the lower end of the gear housing in contact with a ground, the handle is at least partially in contact with the ground.

2. The earth auger according to claim 1, wherein
the handle is at least partially located laterally from the gear housing to receive a reaction force transmitted from the rotation output unit to the gear housing.

3. The earth auger according to claim 1, wherein the handle is loop-shaped.

4. The earth auger according to claim 1, wherein the handle includes a straight portion extending laterally from the gear housing, and a hand guard located below the straight portion.

5. The earth auger according to claim 1, wherein the handle includes a bend curved downward at a farther distance from the gear housing, and a straight portion extending laterally from the gear housing below the bend.

6. The earth auger according to claim 1, further comprising:

a contact member located below of the rotation output unit.

7. The earth auger according to claim 6, wherein the contact member is at least partially located laterally from the gear housing.

8. The earth auger according to claim 6, wherein the contact member is fastened to the gear housing.

9. An earth auger, comprising:

a motor;

a motor housing accommodating the motor;

a handle housing including a grip including a trigger switch operable to activate the motor;

a reducer;

a gear housing accommodating the reducer;

a rotation output unit protruding frontward from the gear housing, the rotation output unit being rotatable under a rotational force transmitted from the motor through the reducer with a drill bit being attached to the rotation output unit; and a handle fastened to the gear housing and at least partially located laterally from the gear housing, wherein with a lower end of the gear housing in contact with a ground, the handle is at least partially in contact with the ground, and the handle includes a straight portion extending laterally from the gear housing, and a hand guard located below the straight portion.

10. An earth auger, comprising:

a motor;

a motor housing accommodating the motor;

a handle housing including a grip including a trigger switch operable to activate the motor, the handle housing disposed above the motor housing;

a reducer;

a gear housing accommodating the reducer, the gear housing disposed below the motor housing;

a rotation output unit protruding frontward from the gear housing, the rotation output unit being rotatable under a rotational force transmitted from the motor through the reducer with a drill bit being attached to the rotation output unit; and a loop-shaped handle disposed on a right side or a left side of the gear housing, the loop-shaped handle including an additional grip extending in a vertical direction.

* * * * *